US005366197A

United States Patent [19]

Westland

[11] Patent Number: 5,366,197

[45] Date of Patent: Nov. 22, 1994

[54] TWO-WAY ADJUSTABLE COPYHOLDER

[75] Inventor: Donald Westland, Marina Del Rey, Calif.

[73] Assignee: Microcomputer Accessories, Inc., Los Angeles, Calif.

[21] Appl. No.: 56,310

[22] Filed: Apr. 30, 1993

[51] Int. Cl.[5] ..... A47G 1/24

[52] U.S. Cl. ..... 248/456; 248/452

[58] Field of Search ..... 248/449, 448, 451, 452, 248/453, 455, 456, 444.1; 400/718

[56] References Cited

U.S. PATENT DOCUMENTS

| | | | |
|---|---|---|---|
| D. 244,331 | 5/1977 | Woods . | |
| 724,629 | 4/1903 | Towle . | |
| 1,568,425 | 10/1934 | Smith . | |
| 2,014,176 | 9/1935 | Henderson | 248/456 |
| 2,194,019 | 8/1938 | Hartsel . | |
| 2,542,718 | 2/1951 | Snell . | |
| 2,600,429 | 6/1952 | Ranseen . | |
| 2,636,702 | 4/1953 | Brody . | |
| 2,642,841 | 6/1953 | Funk . | |
| 2,912,203 | 11/1959 | Townsend | 248/448 |
| 3,095,665 | 7/1963 | Killen | 248/452 X |
| 3,095,834 | 7/1963 | Killen | 248/449 X |
| 3,140,558 | 7/1964 | Cassidy | 248/449 |
| 3,381,928 | 5/1968 | White . | |
| 4,044,980 | 8/1977 | Cummins . | |
| 4,116,414 | 9/1978 | Robertson . | |
| 4,239,171 | 12/1980 | Huls et al. | 248/558 |
| 4,515,338 | 5/1985 | Schneider | 248/460 |
| 4,548,378 | 10/1985 | Worrallo | 248/558 |
| 4,569,498 | 2/1986 | Ermanski | 248/441 |
| 4,577,822 | 3/1986 | Wilkerson | 248/463 |
| 4,824,064 | 4/1989 | Oncale | 248/441 |
| 4,834,334 | 8/1989 | Robins | 248/441 |
| 4,902,078 | 2/1990 | Judd | 248/442.2 X |
| 4,934,648 | 6/1990 | Yueh | 248/442 |
| 4,949,933 | 8/1990 | Stone | 248/442 |
| 4,957,261 | 9/1990 | Cirami | 248/454 |
| 4,960,256 | 10/1990 | Chihara et al. | 248/917 |
| 4,960,257 | 10/1990 | Waters | 248/442 |
| 4,960,258 | 10/1990 | Stocker et al. | 248/467 |
| 5,031,870 | 7/1991 | Higgins | 455/473 |

*Primary Examiner*—Ramon O. Ramirez
*Attorney, Agent, or Firm*—Price, Gess & Ubell

[57] ABSTRACT

A two-way positionable copyholder is provided. A copy support member of the copyholder which receives a document to be transcribed is manually raiseable or lowerable and forwardly or rearwardly tiltable. To this end, the copyholder is provided with a slidable front support leg and a pivotable rear support leg. The front supporting leg engages a rear side of the copy support member, and the pivoting rear supporting leg mounts to the front support leg. A connecting member or tension bar connects the front and rear legs together. A forward end of the connecting member is pivotally mounted to the sliding support leg, whereas a rear or free end of the connecting member is detachably mounted at selected positions along the rear pivoting leg. The height of the copy support member is varied by sliding the front leg with respect to the support member. The angle or tilt of the copy support member is varied by repositioning the free end of the connecting member along the rear leg.

25 Claims, 3 Drawing Sheets

TWO-WAY ADJUSTABLE COPYHOLDER

BACKGROUND OF THE INVENTION

1. Field of the Invention

The invention relates generally to copyholders and, in particular, to a copyholder for use in the vicinity of a computer keyboard and monitor.

2. Description of Related Art

A variety of copyholders have been developed for use with personal computers and personal word processing machines to allow textual copy, such as documents, notes, and the like, to be transcribed into the computer or word processing machine. Considerable operator fatigue may occur if the copy to be transcribed is not properly positioned and angled with respect to the operator. Heretofore, attempts have been made to provide copyholders which can be easily and conveniently positioned. However, such copyholders either lack an adequate degree of adjustability, are mechanically complicated and, hence, expensive, or are too awkward or cumbersome to use easily.

SUMMARY OF THE INVENTION

From the foregoing, it can be appreciated that there is a need to provide an improved copyholder capable of providing an adequate degree of adjustability to allow a document to be positioned at a convenient location and angle with respect to a video display terminal, yet being of sufficiently simple design to be inexpensively manufactured and easily and reliably used.

These and other objects of the invention are achieved by the provision of an adjustable copyholder having a copy support member with a substantially planar front surface for supporting a sheet of copy, a means for holding the sheet of copy onto the front surface of the copy support member, a vertical positioning means for raising or lowering the copy support member with respect to a supporting surface and a tilt positioning means for tilting the copy support member with respect to the support surface.

In a preferred embodiment, a shelf is mounted along a bottom edge of the copy support member and a paper clamp is mounted along a top edge of the support member for securely holding a document. A sliding front supporting leg slidably engages a rear side of the copy support member, and a pivoting rear supporting leg pivotally mounts to the sliding supporting leg. A forward end of a connecting member or tension bar is pivotally mounted to the sliding support leg, and a free end of the connecting member detachably engages with the rear pivoting leg.

With this configuration, the copy support member may be vertically raised or lowered by sliding the support member with respect to the front slidable leg. Further, by repositioning the free end of the connecting member at any one of a variety of positions along the rear support leg, the relative angle between the front and rear supporting legs is varied, thus tilting the planar copy support member.

The invention provides a multiadjustable copyholder which is easily and conveniently used and is constructed from a limited number of simple and inexpensive parts.

BRIEF DESCRIPTION OF THE DRAWING

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED. EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a two-way adjustable copyholder.

Figure 1:
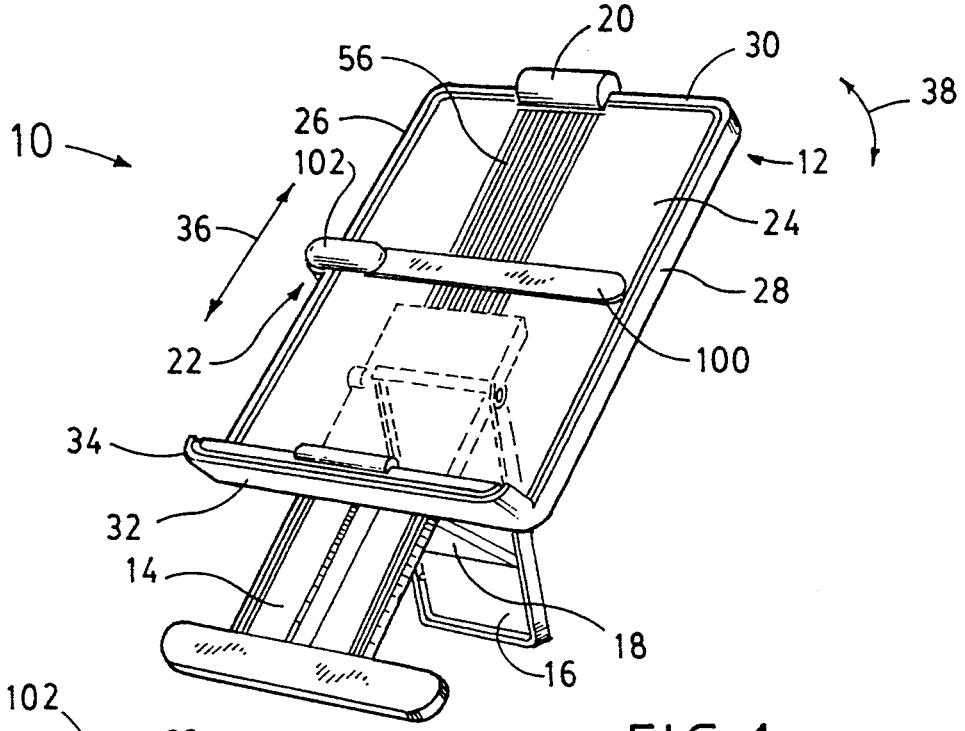
FIG. 1 provides a front perspective view of a preferred embodiment of the copyholder of the invention.

Referring to the figures, a preferred embodiment of the invention will now be described. FIG. 1 illustrates a copyholder 10 having a main copy support member 12, a front slidable support leg 14, a rear pivotable support leg 16, and a connecting member or tension bar 18. Also included in copyholder 10 is a paper clamp assembly 20 and a movable line guide assembly 22.

Support member 12 provides a forward planar surface 24 for supporting a sheet or document (not shown). Support member 12 is generally rectangular and includes left and right vertical edges, 26 and 28, respectively, and upper and lower horizontal edges, 30 and 32, respectively. A shelf 34, which extends generally perpendicularly from forward surface 24, is provided along entire lower edge 32 for supporting a sheet or document. Paper clamp assembly 20 is mounted along a portion of top edge 30 of support member 12. Line guide assembly 22 mounts to left side edge 26 of support member 12 as shown. Alternatively, the line guide assembly may be mounted to right side edge 28. Line guide assembly 22 is slidable and repositionable along edge 26.

Support member 12 is slidably mounted to front leg 14 such that the support member may be manually vertically raised or lowered in a direction indicated by arrows 36. Rear leg 16 is pivotally mounted to front leg 14 such that support 12 may be tilted forwardly or rearwardly, as shown by arrow 38. The interrelation of the components of the copyholder are shown most clearly in an exploded perspective view of FIG. 2. A rear surface 40 of support member 12 is provided with a track 42 for receiving and guiding a rectangular nut 44. Forward leg 14 includes a bore 46 formed near an upper edge of leg 14 for receiving a threaded shaft 48 of a tightening bolt 50. Rear surface 40 of support member 12 also includes a pair of vertical tracks or guides 52. Forward leg 14 includes a pair of forward-facing rims 54, with each rim being formed along a front vertical side edge of forward leg 14. Tracks 52 of support member 12 are separated by a distance equal to a distance separating rims 54 of forward leg 14.

Rims 54 are mounted within respective tracks 52, while bolt 50 is threaded into nut 44 held within track 42. In this manner, planar support 12 is vertically raiseable or lowerable by sliding guide tracks 52 along vertical rims 54. Guide tracks 52 closely receive rims 54 such that planar support 12 is smoothly raised or lowered without any substantial lateral movement and without any significant possibility of jamming. Planar support 12 is manually secured at a selected vertical height by tightening threaded bolt 50 onto nut 44 such that an outer surface of track 42 is drawn into frictional abutment with a forward surface of forward leg 14. To reposition planar support 12, one loosens threaded bolt 50, manually raises or lowers support 12, then retightens threaded bolt 50. A front mounting plate 56 mounts within a shallow rectangular recess formed within front surface 24 of planar support 12 (see also FIG. 1). During assembly, once nut 44 is inserted within track 42, plate 56 is securely mounted to front surface 24 to enclose track 42 to capture nut 44 therein. Plate 56 may be secured by a suitable resilient snap-fit mechanism, or by an appropriate adhesive.

Figure 3:
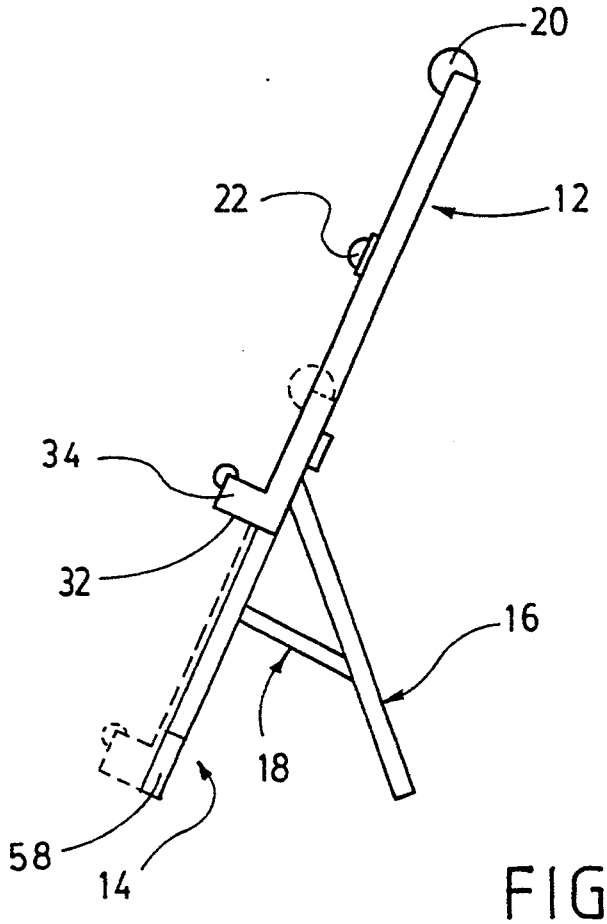
FIG. 3 provides a side elevational view of the copyholder of the invention, illustrating the copyholder in a maximum height configuration in solid lines, and in a minimum height configuration in phantom lines.

Thus, with the provision of guide tracks 52, vertical rims 54, threaded screw 50, and nut 44, planar support 12 is manually raiseable or lowerable to any position within a desired range. The range through which planar support 12 may be raised or lowered is defined by the length of track 42. As shown in FIG. 3, planar support 12 is raiseable from a minimum height position wherein lower edge 32 rests on a support surface even with the bottom edge of a base 58 of forward leg 14 and a maximum height position wherein lower edge 32 of planar support 12 is disposed adjacent to an upper end of forward leg 14.

Referring again to FIG. 2, the mechanism by which planar support 12 may be tilted will now be described. Top end 60 of rear leg 16 is pivotally mounted to a rear surface 62 of forward leg 14. Rear leg 16 is provided with a pair of bores 64 which are disposed adjacent to bores 66 formed on forward leg 14. Pins 67 mount through bores 64 and 66 to pivotally mount rear leg 16 to forward leg 14.

Tension bar or connecting member 18 connects rear surface 62 of forward leg 14 with a forward surface of rear leg 16. A front edge 70 of connecting member 18 is provided with a pair of pegs 72 which are received within a pair of bores 74 formed along rear surface 62 of forward leg 14. Bores 74 are formed along opposing side edges of the rear surface of forward leg 14 below slots 66. A rear edge 77 of connecting member 18 is detachably mountable along a front surface of rear leg 16. Rear leg 16 is provided with a pair of forward-facing vertical inner rims 78, each of which includes a set of two or more slots or notches 80. Lateral pegs 76 formed along rear edge 77 of connecting member 18 detachably engage with notches 80 to secure the rear edge of connecting member 18 to rear leg 16. Preferably, rear leg 16 is provided with a set of six or more pairs of notches 80 for allowing connecting member 18 to be mounted at any of several discrete heights.

Figure 4:
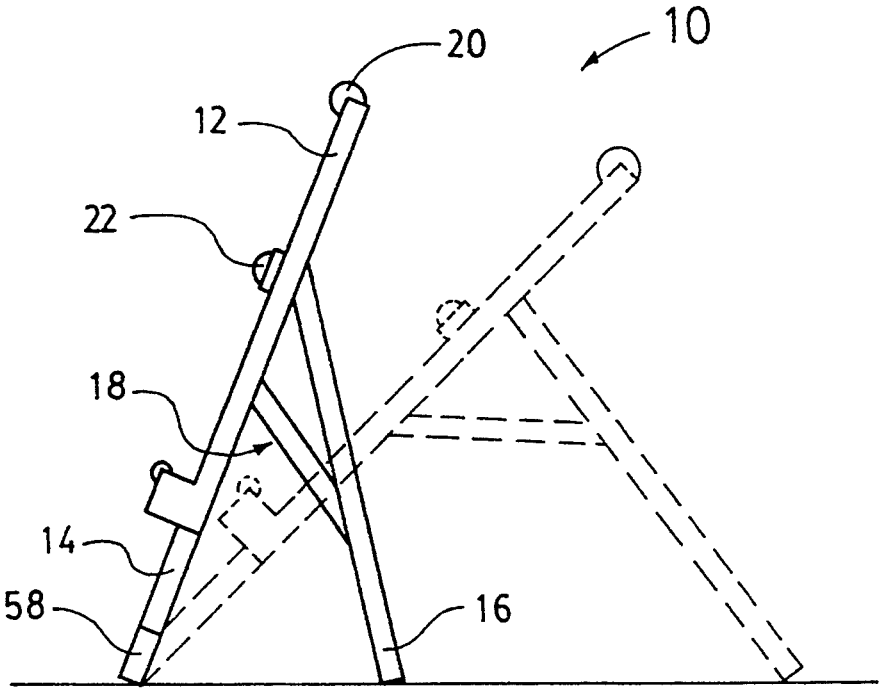
FIG. 4 provides a side elevational view of the copyholder of the invention in an upright configuration in solid lines, and in a rearwardly-tilted configuration in phantom lines.

By pivotally mounting the top end of the rear mounting leg to the front leg, and by providing a repositionable tension bar or connecting member between the forward and rear legs, planar support 12 is manually tiltable. A pivoting range of copyholder 10 is shown in FIG. 4. In solid lines in FIG. 4, copyholder 10 is shown in a minimally-reclined configuration. By "minimally-reclined," it is meant that the planar support is tilted rearwardly from the vertical by only a fairly slight amount. A rearwardly-tilted or maximally-reclined configuration is shown in FIG. 4 with phantom lines. The minimally-reclined configuration of solid lines is achieved by positioning free end 76 of connecting member 18 within a lowermost pair of notches 80 (FIG. 2) within rear leg 16. By securing connecting member 18 within a lowermost set of notches, rear leg 16 is maintained fairly close to forward leg 14 such that an angle separating forward leg 14 and rear leg 16 is fairly narrow. With a narrow angle between the forward and rear legs, a base end of rear leg 16 is held fairly close to base 58 of forward leg 14 such that planar support member 12 is minimally reclined.

The rearwardly-tilted or maximally-reclined configuration of the copyholder shown in phantom lines in FIG. 4 is achieved by positioning free end 76 of connecting member 18 within a topmost pair of notches 80 (FIG. 2) of rear leg 16. In this configuration, rear leg 16 is pushed outwardly from forward leg 14, thus separating the bases of the support legs, causing planar support 12 to recline. Preferably, copyholder 10 is configured such that connecting member 18 is substantially horizontal when the copyholder is disposed in the rearwardly-tilted configuration. The range through which support member 12 may be pivoted depends upon the distance separating the topmost and bottommost pairs of notches of rear leg 16. Although shown in FIG. 2 as having a discrete number of notches 80 for receiving connecting member 18, an alternative mechanism may be provided for mounting connecting member 18 to rear leg 16 to allow the connecting member to be secured at any position within a continuous range. For example, a set of mounting screws similar to threaded screw 50 may be provided for tightening rear end 76 of connecting member 18 onto tracks formed within rear leg 16.

Figure 2:
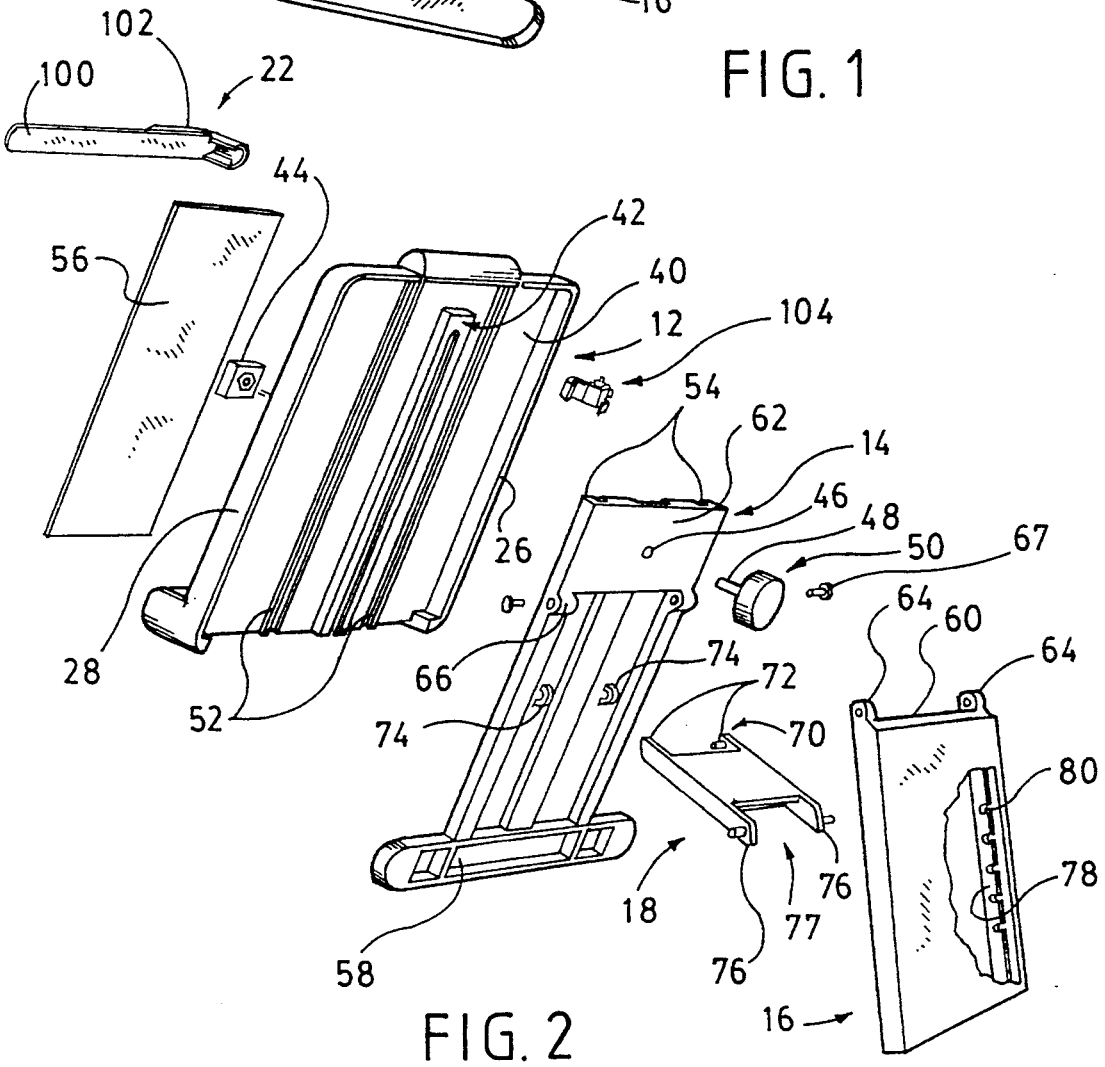
FIG. 2 provides a rear perspective exploded view of the copyholder of the invention.

Line guide assembly 22 will now be described with reference to FIGS. 1 and 2. Line guide assembly 22 includes a transparent line guide bar 100 which has sufficient length to extend substantially across front surface 24 of planar member 12 between left side edge 26 and right side edge 28 (FIG. 1). Line guide bar 100 is transparent to allow text to be easily viewed through the line guide. A base end 102 of line guide bar 100 is slidably mounted to side edge 26 to allow the line guide bar to be vertically raised or lowered along planar support member 12. A mounting bracket 104 (FIG. 2) snaps over side edge 26 of planar support 12. Base end 102 snaps onto a forwardly-extending portion of bracket 104.

Line guide bar 100 is provided with a total of three degrees of movement with respect to support member 12. Line guide bar 100 may be slidably repositioned along front surface 24, pivoted outwardly from forward surface 24, or raised or lowered onto or off of forward surface 24. The line guide bar may be conveniently repositioned to allow documents to be mounted onto the copyholder conveniently identify a particular line of text on a document inserted onto the copyholder.

Figure 5:
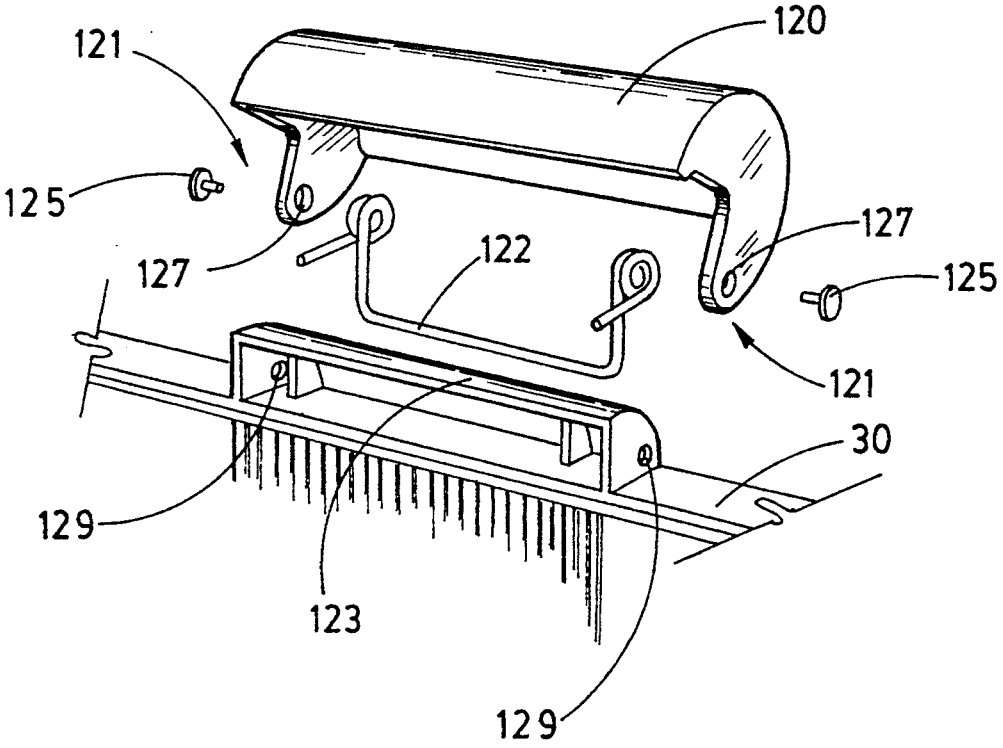
FIG. 5 provides a perspective exploded view of a paper clamp assembly of the copyholder of the invention.

With reference to FIG. 5, clamp mechanism 20 will be now be described. Clamp mechanism 20 includes a clamping bar 120 having a semicircular cross-section and having an inner portion 121 mounted to a housing 123 projecting from top edge 30 of planar support 12 (FIG. 1). A pair of pins 125 mount through bores 127 and 129 formed in clamping bar 120 and housing 123, respectively. A spring mechanism 122 is mounted within an internal chamber of clamping bar 120. Spring mechanism 122 biases clamping bar 120 in a forward direction to clamp documents or sheets of paper onto front surface 24 of planar support 12.

What has been described is a copyholder capable of securely holding a document to be transcribed in the vicinity of a video display terminal. A planar support of the copyholder may be raised and lowered or tilted as desired. Hence, documents to be transcribed may be positioned at any of a wide range of possible heights and angles with respect to the video display. All components of the copyholder may be constructed of inexpensive, durable plastic, with the possible exception of one or two screws, nuts, pins, and spring mechanisms, which are preferably composed of a suitable metal. The copyholder is easy to manufacture, assemble, and use.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An adjustable copyholder comprising:

a supporting member having a substantially planar front surface and a lower support ledge for supporting a sheet of copy;

means for pressing the sheet of copy against the front surface of the supporting member;

vertical positioning means for jointly raising or lowering the front surface and lower support ledge of the supporting member with respect to a supporting surface, whereby a sheet of copy pressed against the supporting member is jointly raised and lowered with the supporting member; and tilt positioning means for tilting the supporting member.

2. The adjustable copyholder of claim 1, wherein the vertical positioning means comprises:

a slidable supporting leg having a top end slidably engaged with a rear surface of the supporting member and having a base along a bottom end for resting on the supporting surface; and locking means for detachably securing the top end of the slidable supporting leg at a selected position along the rear surface of the supporting member, such that the height of the supporting member is adjustable by releasing the locking means, sliding the supporting member with respect to the leg, then resecuring the supporting member with the locking means.

3. The adjustable copyholder of claim 2, wherein the slidable supporting leg engages with vertical tracks provided along the rear surface of the supporting member, and wherein the locking means comprises a screw mounted through the slidable supporting leg, the screw releasably frictionally abutting the supporting member.

4. The adjustable copyholder of claim 3, wherein a shaft of the screw is received within a slot formed within a track along the rear surface of the supporting member, with a head of the screw extending outwardly from the supporting member through the slot and through a bore formed in the slidable supporting leg, with a nut mounted to the shaft of the screw within the track, the slidable supporting leg being locked by tightening the screw onto the nut, thus pulling the head of the screw into frictional abutment against an exterior surface of the track of the rear surface of the supporting member.

5. The adjustable copyholder of claim 2, wherein the tilt positioning means comprises a pivotable support leg having a top end pivotally mounted to the slidable supporting leg and having a base along a free end for resting on the supporting surface.

6. The adjustable copyholder of claim 5 wherein the tilting means further comprises:

a connecting member having a free end and a fixed end pivotally mounted to a rear surface of the slidable supporting leg below the top end of the pivotable supporting leg; and connecting member mounting means for detachably mounting the free end of the connecting member to one of a plurality of intermediate positions along a front surface of the pivoting leg.

7. The adjustable copyholder of claim 6, wherein the connecting member mounting means comprises:

a set of pairs of notches formed within the front surface of the pivotable supporting leg, each of the pairs of notches sized for detachably receiving and holding opposing corners of the free end of the connecting member.

8. The adjustable copyholder of claim 6, wherein the copyholder is tiltable through a range between a reclined position wherein the free end of the connecting member is mounted in the vicinity of a top end of the pivotable supporting leg and an upright position wherein the free end of the connecting member is mounted in the vicinity of a bottom end of the pivotable supporting leg.

9. The adjustable copyholder of claim 2, wherein the copyholder is adjustable through a range between a maximum height position wherein the top end of the slidable supporting leg is secured in a vicinity of a bottom edge of the supporting member and a minimum height position wherein the top end of the slidable supporting leg is secured in a vicinity of a top edge of the supporting member.

10. The adjustable copyholder of claim 1, wherein the tilt positioning means tilts the supporting member about an axis defined by the intersection of the supporting surface and a plane defined by the forward surface of the supporting member.

11. The adjustable copyholder of claim 1, wherein the copyholder is tiltable through a range between a reclined position and an upright position and wherein the copyholder is vertically positionable through a range between a minimum height position wherein a bottom edge of the supporting member is disposed near the supporting surface and a maximum height position wherein the bottom edge of the supporting member is elevated above the supporting surface.

12. The adjustable copyholder of claim 1, wherein the means for holding the sheet of copy comprises:

paper clamping means mounted along a top edge of the front surface of the supporting member for securely clamping paper to the front surface.

13. The adjustable copyholder of claim 1, further comprising:

a line guide means for marking a vertical position along a sheet held by the copyholder.

14. An adjustable copyholder comprising:

a supporting member having a substantially planar front surface for supporting a sheet of copy;

paper clamping means mounted along a top edge of the front surface of the supporting member for securely clamping papers to the front surface;

vertical positioning means for raising or lowering the supporting member with respect to a supporting surface; and tilt positioning means for tilting the supporting member.

15. An adjustable copyholder comprising:

a planar supporting member having front and back sides and top and bottom edges;

a shelf mounted along the bottom edge of the front side of the supporting member;

a paper clamp mounted along the top edge of the front side of the planar member;

a sliding supporting leg slidably engaged with the rear side of the planar supporting member;

a pivoting supporting leg pivotally mounted to an intermediate portion of a rear side of the sliding supporting leg; and a connecting member pivotally mounted to the rear surface of the sliding supporting leg below the intermediate portion, the connecting member having a free end detachably engaged with an intermediate portion of a front surface of the pivoting leg.

16. An adjustable copyholder comprising:

a planar supporting member having front and back sides and top and bottom edges;

a shelf mounted along the bottom edge of the front side of the supporting member;

a sliding supporting leg slidably engaged with the rear side of the planar supporting member;

locking means for detachably securing a top end of the sliding supporting leg at a selected position along a rear surface of the planar supporting member, said sliding supporting leg engaging with vertical tracks provided along the rear surface of the planar supporting member;

a pivoting supporting leg pivotally mounted to an intermediate portion of a rear side of the sliding supporting leg; and a connecting member pivotally mounted to the rear surface of the sliding supporting leg below the intermediate portion, the connecting member having a free end detachably engaged with an intermediate portion of a front surface of the pivoting leg.

17. An adjustable copyholder comprising:

a supporting member having a substantially planar front surface for supporting a sheet of copy;

means for holding the sheet of copy on the front surface of the supporting member;

vertical positioning means for raising or lowering the support member with respect to a supporting surface, the vertical positioning means comprising a slidable supporting leg having a top end slidably engaged with a rear surface of the supporting member and having a base along a bottom end for resting on the supporting surface;

locking means for detachably securing the top end of the slidable supporting leg at a selected position along the rear surface of the supporting member, such that the height of the supporting member is adjustable by releasing the locking means, sliding the supporting member with respect to the leg, then resecuring the supporting member with the locking means; and tilt positioning means for tilting the supporting member.

18. The adjustable copyholder of claim 17, wherein the slidable supporting leg engages with vertical tracks provided along the rear surface of the supporting member, and wherein the locking means comprises a screw mounted through the slidable supporting leg, the screw releasably frictionally abutting the supporting member.

19. The adjustable copyholder of claim 18, wherein a shaft of the screw is received within a slot formed within a track along the rear surface of the support member, with a head of the screw extending outwardly from the support member through the slot and through a bore formed in the slidable supporting leg, with a nut mounted to the shaft of the screw within the track, the slidable leg being locked by tightening the screw onto the nut, thus pulling the head of the screw into frictional abutment against an exterior surface of the track of the rear surface of the support member.

20. The adjustable copyholder of claim 17, wherein the tilting means comprises a pivotable support leg having a top end pivotally mounted to the slidable supporting leg and having a base along a free end for resting on the supporting surface.

21. The adjustable copyholder of claim 20, wherein the tilting means further comprises:

a connecting member having a free end and a fixed end pivotally mounted to a rear surface of the slidable supporting leg below the top end of the pivotable supporting leg; and connecting member mounting means for detachably mounting the free end of the connecting member to one of a plurality of intermediate positions along a front surface of the pivoting leg.

22. The adjustable copyholder of claim 21, wherein the connecting member mounting means comprises:

a set of pairs of notches formed within the front. surface of the pivotable supporting leg, each of the pairs of notches sized for detachably receiving and holding opposing corners of the free end of the connecting member.

23. The adjustable copyholder of claim 21, wherein the copyholder is tiltable through a range between a reclined position wherein the free end of the connecting member is mounted in the vicinity of a top end of the pivotable supporting leg and an upright position wherein the free end of the connecting member is mounted in the vicinity of a bottom end of the pivotable supporting leg.

24. The adjustable copyholder of claim 17, wherein the copyholder is adjustable through a range between a maximum height position wherein the top end of the slidable supporting leg is secured in the vicinity of a bottom edge of the supporting member and a minimum height position wherein the top end of the slidable supporting leg is secured in a vicinity of a top edge of the supporting member.

25. An adjustable copyholder comprising:

a supporting member having a substantially planar front surface for supporting a sheet of copy;

a shelf mounted along a bottom edge of the front surface of the supporting member;

vertical positioning means for raising or lowering the supporting member with respect to a supporting surface; and tilt positioning means for tilting the supporting member.

* * * * *